US008548175B2

(12) United States Patent
Im et al.

(10) Patent No.: US 8,548,175 B2
(45) Date of Patent: Oct. 1, 2013

(54) METHOD FOR RECOGNIZING EAR PHONE IN PORTABLE TERMINAL AND APPARATUS THEREOF

(75) Inventors: Mu Seon Im, Gyeonggi-do (KR); Hyung Woo Park, Gyeonggi-do (KR); Young Wan Cho, Gyeonggi-do (KR); Nam Hyeong Kim, Gyeonggi-do (KR); Ho Sik Cho, Seoul (KR)

(73) Assignee: Samsung Electronics Co., Ltd., Yongton-gu, Suwon-si, Gyeonggi-do (KR)

( * ) Notice: Subject to any disclaimer, the term of this patent is extended or adjusted under 35 U.S.C. 154(b) by 535 days.

(21) Appl. No.: 12/789,499

(22) Filed: May 28, 2010

(65) Prior Publication Data

US 2010/0303251 A1 Dec. 2, 2010

(30) Foreign Application Priority Data

May 29, 2009 (KR) ..... 10-2009-0047546

(51) Int. Cl.
*H04R 1/10* (2006.01)

(52) U.S. Cl.
USPC ..... 381/74

(58) Field of Classification Search
USPC ..... 381/74, 123, 111–117, 91, 92, 56–58, 381/384, 395; 455/557, 568; 379/420.04, 379/421–425, 430
See application file for complete search history.

(56) References Cited

U.S. PATENT DOCUMENTS

| | | | | |
|---|---|---|---|---|
| 7,248,707 | B2 * | 7/2007 | Peng et al. | 381/74 |
| 2005/0201568 | A1 * | 9/2005 | Goyal | 381/74 |
| 2010/0272252 | A1 * | 10/2010 | Johnson et al. | 379/430 |

* cited by examiner

*Primary Examiner* — Lao Lun-See
(74) *Attorney, Agent, or Firm* — Cha & Reiter, LLC

(57) ABSTRACT

Disclosed is an apparatus for recognizing an earphone of a portable terminal that includes an interface unit which is connected to the earphone; a controller which performs a switch operation by determining whether a switch key of the earphone is inputted, according to a change of a current of a first port and a voltage of a second port, when the connection of the earphone is sensed; and an audio processing unit that outputs an audio signal to the earphone under the control of the controller.

18 Claims, 5 Drawing Sheets

METHOD FOR RECOGNIZING EAR PHONE IN PORTABLE TERMINAL AND APPARATUS THEREOF

CLAIM OF PRIORITY

This application claims, under 35 USC 119(a), priority to and the benefit of the earlier filing date of, that patent application filed in the Korean Intellectual Property Office on May 29, 2009 and assigned Serial No. 10-2009-0047546, and the entire disclosure of which is hereby incorporated by reference.

BACKGROUND OF THE INVENTION

1. Field of the Invention

The present invention relates to the field of portable terminals, and more particularly, to a method and apparatus for recognizing a kind of earphone of a portable terminal 2. Description of the Related Art As the use of portable terminals have increases, the number of different, supplementary features of a portable terminal has also increased. For instance, various supplementary features such as a file playing function that enables a user to watch a video file or listen to audio file containing music or foreign language study, for example, a camera function that can photograph or take video images, a digital broadcasting playing function that enables a user to watch broadcast data transmitted from a broadcast station, a wireless internet function that enables a user to access and utilize a public network, e.g., the internet, and a message function that can transmit short messages or multimedia messages, have been incorporated into applications that may be accessed using a portable terminal. The file playing function, among the functions of portable terminal, particularly, the audio file playing function is a function for playing various audio files stored in the portable terminal and outputting audio file through speaker which is included in portable terminal. Among those functions, the portable terminal user frequently makes use of earphone so that an audio signal outputted from portable terminal may not heard by others or the user can more clearly hear the audio signal. Accordingly, the portable terminal includes an earphone interface for the connection of an earphone, and particularly, supports a four-pole earphone interface for the support of voice call according to mobile communications function. In the portable terminal, in a method for recognizing the switch operation of a four-pole earphone, if a current generated in a microphone bias port is in the range of a preset current range, the portable terminal determines that a switch key has even inputted from user, and executes the switch operation. At this time, the four-pole earphone is configured to distribute the ground terminal GND of a three-pole earphone to a microphone terminal, MIC, and a ground terminal to use. Accordingly, in the structure of the earphone, the microphone terminal of a four-pole earphone and the ground terminal GND of a three-pole earphone are configured to occupy the same location. In this case, if three-pole earphone is inserted into the jack of a four-pole microphone port of a portable terminal, the microphone terminal of the four-pole ear port contacts the ground terminal of three-pole earphone so that a signal, which is identical with a signal that is obtained when a switch key is inputted, is detected. Hence, the portable terminal can execute a corresponding function. In addition, when the four-pole earphone is inserted into, or removed from, the four-pole ear jack, the ground terminal of a four-pole ear jack contacts the microphone terminal of the four-pole earphone, so that a signal, which is identical with a signal that is obtained when a switch key is inputted, is sent. Hence, the portable terminal can execute a corresponding function.

Thus, the portable terminal can mistakenly determine that a switch key has been inputted when inserting a three-pole earphone into a four-pole ear jack. Hence, a malfunction of executing the switch operation is generated.

SUMMARY OF THE INVENTION

The present invention provides a method and apparatus for recognizing an earphone of a portable terminal that is capable of performing a switch operation without causing a malfunction when a four-pole earphone is inserted into or removed from a four-pole earphone jack in portable terminal.

The present invention further provides a method and apparatus for recognizing an earphone of a portable terminal which is capable of performing a switch operation without malfunction when inserting a three-pole earphone in case of using three-pole earphone in portable terminal.

In accordance with an aspect of the present invention, an apparatus for recognizing an earphone of a portable terminal includes an interface unit which is connected to the earphone; a controller which performs a switch operation by determining whether a switch key of the earphone is inputted, according to a change of a current of a first port and a voltage of a second port, when the connection of the earphone is sensed; and an audio processing unit which outputs an audio signal to the earphone under the control of the controller.

In accordance with another aspect of the present invention, a method of recognizing an earphone of a portable terminal includes sensing whether an earphone is connected to an interface unit; applying a reference voltage to a first port, and measuring a change of a current at first port and a voltage of a second port, when the connection of earphone is sensed in the interface unit; and determining whether a switch key of the earphone is inputted, according to a result of the measurement, and executing a switch operation when the switch key has been determined to be input.

In accordance with another aspect of the present invention, a method operable in a portable device for determining a earphone connection, the method comprising: detecting the presence of the earphone connection; measuring an electrical current at a first port and an electrical voltage at a second port; determining whether each of the measured electrical current and the electrical voltage are within corresponding ranges; validating an input as being appropriate when the current and the voltage change simultaneously.

BRIEF DESCRIPTION OF THE DRAWINGS

The above and other aspects, features, and advantages of certain exemplary embodiments of the present invention will be more apparent from the following description taken in conjunction with the accompanying drawings, in which.

DETAILED DESCRIPTION OF THE INVENTION

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

In the embodiment of the present invention, 'switch key' can be a Send/End key used in a portable terminal. That is, the switch key can be included in the configuration of an earphone and can generate an input signal for requesting a switch function such as dialing, call receiving, and hang up.

Before the detailed description of the present invention and for the sake of convenience in illustration, a portable terminal according to an exemplary embodiment of the present invention is illustrated as a mobile communications terminal. However, the present invention is not limited to this.

That is, the portable terminal according to an exemplary embodiment of the present invention has an earphone interface, and thus the term portable terminal can be applied to all types of telecommunication devices, multimedia devices, and applications thereof, such as a mobile communications terminal in which telecommunication function is built in, a portable phone, a digital broadcasting terminal, a Personal Digital Assistants (PDA), a Smart Phone, an International Mobile Telecommunication 2000 (IMT-2000) terminal, a Global Standard for Portable Communication (GSM) terminal, a Wideband Code Division Multiple Access (WCDMA) terminal, a High Speed Downlink Packet Access (HSDPA) terminal, a World Interoperability for Microwave Access (Wimax) terminal and a Universal Mobile Telecommunication Service (UMTS) terminal, and the like.

Figure 1:
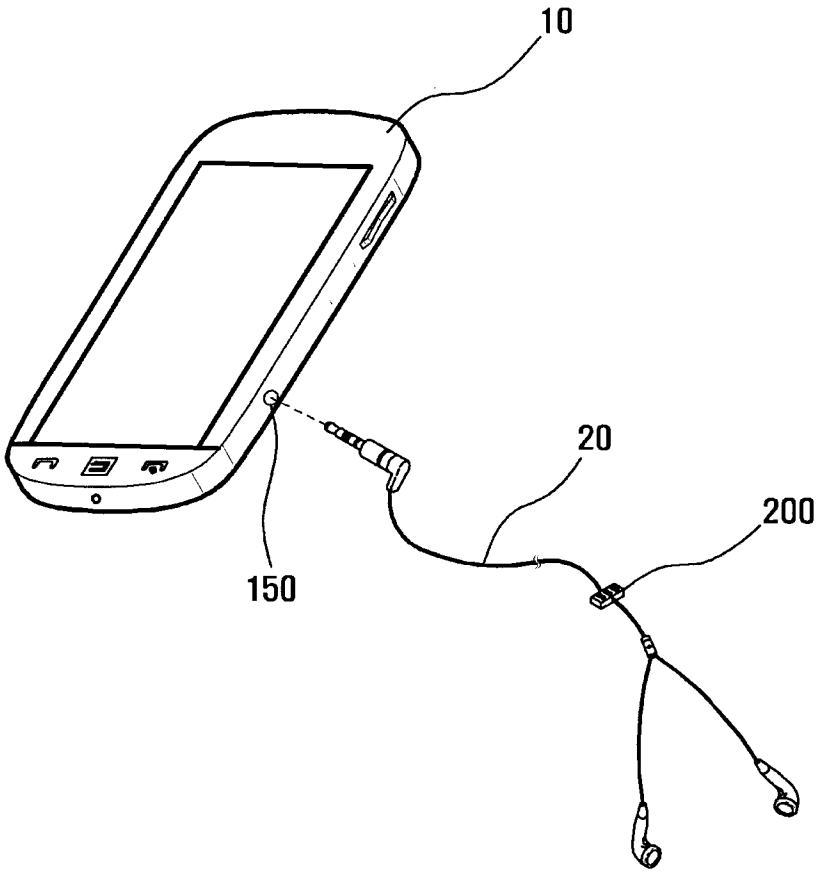
FIG. 1 is a drawing illustrating a configuration of a portable terminal to which an earphone is connected according to an exemplary embodiment of the present invention.

FIG. 1 is a drawing illustrating a schematic configuration of a portable terminal to which an earphone is connected according to an exemplary embodiment of the present invention.

Referring to FIG. 1, the portable terminal according to an exemplary embodiment of the present invention includes a portable terminal body 10 and an earphone 20 attachable to the portable terminal body 10. In the portable terminal of the present invention having such configuration, it is preferable that the earphone 20 has an interface unit 150 which connects the portable terminal body 10 and the earphone 20 to each other. Further the interface unit 150 provides a means for detaching the earphone 20 from the portable terminal body 10.

The portable terminal body 10 can be classified into various types, e.g., the slide type, the folder-type, the bar type and the full touch type or the like. Such a portable terminal body 10 includes interface unit 150 in which earphone 20 can be attached and detached. The interface unit 150 can be configured to include a connection terminal of a certain number connections. Particularly, the interface unit 150 according to the embodiment of the present invention can include a terminal which can determine between a three-pole earphone and a four-pole earphone. Moreover, the interface unit 150 can be connected with an external device according to various optional functions of portable terminal. For instance, the interface unit 150 can be connected with an external device corresponding to each function so as to support an earphone function or an external speaker function. The earphone 20 includes a connection unit that is detachable from the interface unit 150 of the portable terminal, a pair of ear speakers, an ear-microphone for collecting a voice signal of a user in voice communication (not shown), and a switching unit 200 including a switch key for requesting or terminating a call. At this time, the switching unit 200 includes a switch key for initiating or terminating a telephone call (Send/End), and for sending a signal corresponding to user's input to the portable terminal. Such an earphone 20 outputs an audio signal through a pair of ear speakers (buds) under the control of the portable terminal after being connected to the portable terminal body 10. Particularly, the earphone 20 according to the embodiment of the present invention can include a means for determining the kind of the earphone 20, i.e., three-pole earphone or four-pole earphone, when the earphone is connected to the portable terminal. The portable terminal of the present invention having such configuration can change the path of the audio signal connected to the interface unit 150 according to the kind of the connected earphone 20. That is, the portable terminal can check the kind of the earphone 20 that is connected to the interface unit 150 through a comparator, connect the output of comparator to a control terminal of switches that can change the path of audio signal so that the path of the audio signal can be changed through the switching operation of the switches.

Figure 2:
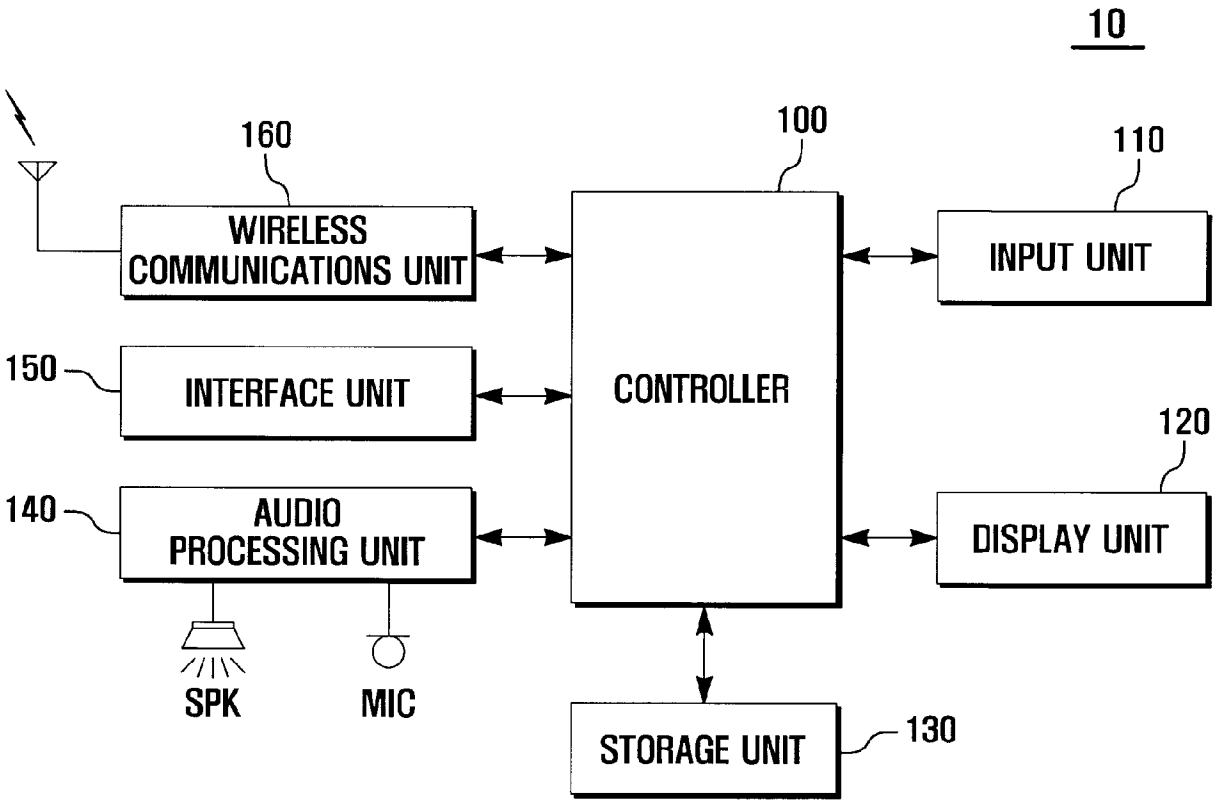
FIG. 2 is a block diagram illustrating a schematic configuration of a portable terminal body according to an exemplary embodiment of the present invention.

FIG. 2 is a block diagram illustrating a schematic configuration of a portable terminal body 10 according to an exemplary embodiment of the present invention.

Referring to FIG. 2, the portable terminal body 10 according to an exemplary embodiment of the present invention can include an input unit 110, a display unit 120, a storage unit 130, an audio processing unit 140, an interface unit 150, a wireless communications unit 160 and a controller 100.

The input unit 110 includes at least one of a numeric key, a character key and a function key for inputting a number and/or character information and/or setting various functions. After the input unit 110 generates an input signal for activating a voice communications, an input signal for selecting a file stored in the storage unit 130 (e.g., an input signal for playing a selected file in response to user's input) can be sent to the controller 100. Particularly, in the input unit 110, the generation of an input signal corresponding to a specific key can be limited in case the earphone 20 is connected to the interface unit 150.

The display unit 120 displays video data outputted from the controller 100, user data requested from user and a supplementary feature screen. Here, the display unit 120 can include a liquid crystal display (LCD). However, the display unit 120 is not limited to LCD. That is, the display unit 120 can be Organic Light Emitting Diodes (OLEDs) and the applications thereof. Particularly, in case the earphone 20 is connected through the interface unit 150, the display unit 120 can display a message on the screen under the control of the controller 100 that the earphone 20 is connected.

When the earphone 20 is connected to the interface unit 150, the controller 100 recognizes the earphone 20, and, based on this recognition, the display unit 120 can display the connection state of the earphone 20. That is, the display unit 120 can generate a pop up window informing the user of the connection of the earphone 20 or display an icon in one side of screen. The connection state and service providing state of the earphone 20 may not be displayed according to the intention of the portable terminal designer or may be differently displayed.

The storage unit 130 can store the Operating System (OS) for booting or starting the portable terminal, and application programs for each function of portable terminal, e.g., the file playing function, the camera function, and the video broadcasting function or the like. Moreover, the storage unit 130 can store user data which is generated according to the use of the portable terminal, and data which is received through a communications channel. To this end, the storage unit 130 can be classified into a program area and a data area. The program area can store the application programs for supporting above-described functions. Particularly, the program area can store a program that can classify the kind of earphone according to the microphone impedance of the earphone, and a program which can classify the kind of earphone by using a switch resistance value of the microphone. The data area performs the function of storing various data such as data that is generated while performing the application programs, data inputted by the user, and phone book data. Particularly, the data area according to an exemplary embodiment of the present invention performs the function of storing information relating to the kind of earphone so as to classify the kind of the earphone connected to the interface unit 150. That is, the data area can store data associated with a microphone impedance value and a switch resistance value of a specific earphone. The audio processing unit 140 outputs the audio signal sent from the controller 100 through the speaker SPK or transmits the audio signal, such as a voice signal, inputted from the microphone MIC to the controller 100. That is, the audio processing unit 140 converts voice/sound data into an audible sound under the control of the controller 100 and outputs the sound through speaker SPK, converts an audio signal, such as voice signal, received from the microphone MIC to digital data and send it to the controller 110. Moreover, when the earphone 20 is connected to, or separated from, the interface unit 150, the audio processing unit 140 can output an audio signal for informing the user of a connection or a separation. Here, this audio signal can be changeably performed according to a menu setting or a volume setting of the portable terminal. Particularly, according to the kind of the earphone which is connected to the interface unit 150, in the audio processing unit 140 according to an exemplary embodiment of the present invention, the operation of the microphone (MIC) can be differentiated. That is, the audio processing unit 140 can deactivate the microphone (MIC) in case the four-pole earphone is connected to the interface unit 150, and an audio signal for a corresponding function can be outputted according to a switch key 200 input signal of the earphone 20. The interface unit 150 provides a connection means that enables the earphone 20 to contact the portable terminal body 10 to send and receive an audio signal. In other words, the interface unit 150 provides an interface for communications between the portable terminal body 10 and the earphone 20, and provides a path for transmitting the voice signal sent from the ear-microphone of the earphone 20 to the controller 100. Moreover, the interface unit 150 can provide a path for transmitting the function sound and/or sound effect generated in the controller 100 to the earphone 20 or for transmitting the signals received from the wireless communications unit 160 to the earphone 20.

The wireless communications unit 160 performs the transceiving of a signal relating with the mobile phone communication, such as short message service (SMS), multimedia message service (MMS), voice communications and/or data communications or the like. Moreover, the wireless communications unit 160 converts voice/sound data and control data into a wireless signal and transmits it to a base station, and receives a wireless signal from the base station and converts it into voice/sound data and control data and sends it to the controller 100. To this end, the wireless communications unit 160 includes a wireless frequency transmitter which up-converts and amplifies the frequency of the transmitted signal, and a wireless frequency reception unit which low-noise amplifies the received signal and down-converts the frequency. Particularly, the wireless communications unit 160 according to an exemplary embodiment of the present invention performs the role of transmitting a voice signal of a user to another portable terminal during voice call service under the control of the controller 100. The controller 100 controls the overall operation of the portable terminal and a signal flow between internal blocks of the portable terminal. That is, the controller 100 controls a signal flow between each configuration such as the input unit 110, the display unit 120, the storage unit 130, the audio processing unit 140, the interface unit 150 and the wireless communications unit 160. Particularly, the controller 100 can use a General Purpose Input/Output (GPIO) port to recognize the earphone 20 connected to the interface unit 150. In case a four-pole earphone is connected, the controller 100 controls the audio processing unit 140 so that audio signal can be supplied to the left side ear speaker and the right side ear speaker, and control the microphone (MIC) to be deactivated. Moreover, the controller 100 controls the audio processing unit 140 to collect a signal received from the ear-microphone of the four-pole earphone and sends it to the wireless communications unit 160. Accordingly, a user can perform a voice communications by using the four-pole earphone. If a four-pole earphone is connected to the interface unit 150, the controller 100 can apply microphone bias voltage to a microphone bias port. At this time, the microphone bias voltage can be divided by the microphone impedance and the bias resistance of the four-pole earphone. Then, when the earphone terminal is contacted with the microphone port and an interrupt corresponding to a switch key input signal is generated, the controller 100 measures the current of the microphone bias port and the voltage of the microphone plus (MIC+) port.

In detail, if an input signal of the microphone port is generated while the four-pole earphone is connected to the interface unit 150, the controller 100 can measure the current of the microphone bias port and the voltage of the microphone plus (MIC+) port so as to determine whether it is a switch key input signal according to the intention of the user. Here, the controller 100 can store the value of a range of the current of the microphone bias port which is generated when the switch key was inputted and a range of the voltage of microphone plus (MIC+) port. That is, the controller 100 can pre-set the range of the voltage of the microphone plus port by dividing the microphone impedance into the microphone impedance and sum of bias resistance and multiplying the microphone bias voltage and the current flowing in the mike bias port. If the current of the measured microphone bias port and the voltage of the microphone (MIC+) plus port are in the range of a preset range, the controller 100 determines whether the current of the microphone bias port and the voltage of the microphone plus (MIC+) port were simultaneously changed. At this time, if it is sensed that the current of the microphone bias port and the voltage of the microphone plus port were simultaneously changed, the controller 100 determines that a switch key is inputted by the input of a user, so that the controller 100 can execute the switch operation. Hence, the controller 100 can prevent a mis-identification of a switch input caused by the contact between the earphone terminal and the interface unit 150 in the attachment and detachment of earphone.

Figure 3:
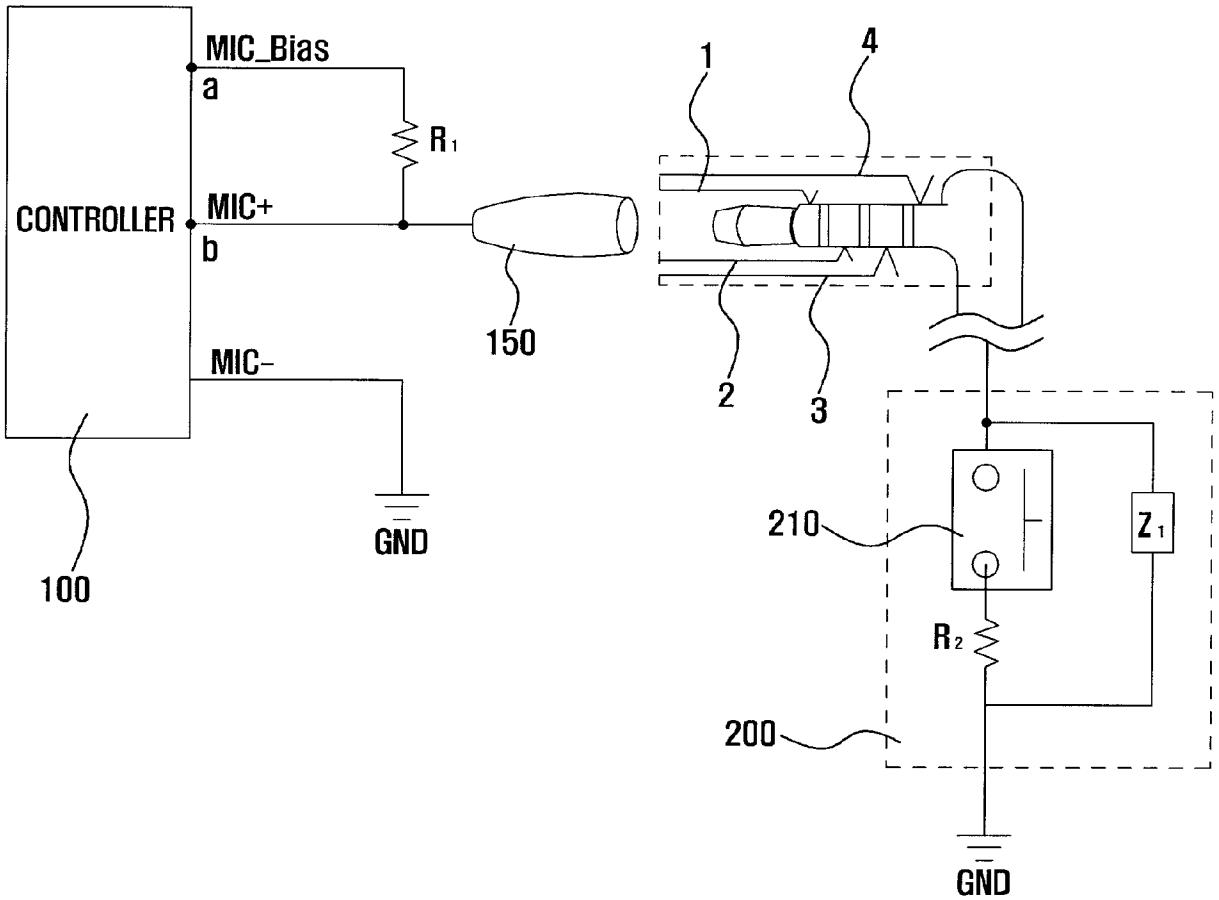
FIG. 3 is a circuit diagram illustrating an interface and switch operation between a portable terminal and an earphone according to an exemplary embodiment of the present invention.

FIG. 3 is a circuit diagram illustrating an interface and switch operation between a portable terminal and an earphone according to an exemplary embodiment of the present invention.

Referring to FIG. 3, in the circuit configuration, the four-pole earphone 20 includes a left side ear speaker terminal (Ear L) 1, a right side ear speaker terminal (Ear R) 2, a mike terminal (MIC) 3 and a ground terminal (GND) 4 connected to the interface unit 150 of the portable terminal body 10. While being connected to the interface unit 150, the four-pole earphone 20 having such configuration can be contacted with a signal line corresponding to each terminal of the interface unit 150.

In case the four-pole earphone 20 is connected to the interface unit 150, the left side ear speaker terminal 1 is connected to a signal line connected to a 'L' port of the audio processing unit 140. Accordingly, the audio signal outputted to the 'L' port of the audio processing unit 140 is sent to the left side ear speaker terminal 1 through the signal line. Moreover, the right side ear speaker terminal 2 is connected to the signal line connected to the 'R' port of the audio processing unit 140. Accordingly, the audio signal outputted to the 'R' port of the audio processing unit 140 is sent to the right side ear speaker terminal 2 through the signal line. Such connections are well known in the art and need not illustrated herein so as to avoid complicating the invention shown in FIG. 3. Moreover, the microphone terminal 3 is connected to the signal line connected to a 'MIC' port of the audio processing unit 140. Accordingly, the audio signal outputted from the microphone terminal 3 of the four-pole earphone 20 is sent to the 'MIC' port of the audio processing unit 140 through the signal line. And the ground terminal 4 is connected to a ground line of the interface unit 150. Moreover, the four-pole earphone 20 includes the switching unit 200. The switching unit 200 can include a switch key 210, a microphone impedance Z1 and a switch resistance R2 to generate a switch signal. Firstly, if the four-pole earphone 20 is connected to the interface unit 150, the controller 100 applies a reference voltage VDD (not shown) to microphone bias port a. For instance, the controller 100 can apply a voltage ranging from 0V to 2.2V, to the microphone bias port a (MIC_Bias a). At this time, the reference voltage VDD outputted from the microphone bias port a (MIC_Bias a) is divided by a bias resistance R1, a switch resistance R2 and a mike impedance Z1.

Thus, controller 100 can store a microphone impedance value Z1 and a switch resistance R2 value about the bias resistance R1 and a specific earphone. The above described values can be changed according to the kind of earphone, and can be set in the manufacturing process of earphone so that they can be used for determining whether the earphone is connected through the interface unit 150. That is, the controller 100 can divide the reference voltage VDD outputted from the microphone bias port a (MIC_Bias a) through the bias resistance value R1, the switch resistance R2 value, and the microphone impedance value Z1. Here, in case the switch key 210 is not inputted, the reference voltage VDD provided from a microphone bias power supply unit (not shown) is divided by the bias resistance R1 and the microphone impedance Z1. For instance, in case the switch key 210 is not inputted, the voltage of the microphone plus port b (MIC+b) can be formed according to the formula of dividing the microphone impedance value Z1 by the sum of the bias resistance value R1 and the microphone impedance value Z1 and multiplying the divided value by the microphone bias reference voltage VDD. The reference voltage VDD applied to the microphone bias port a can be divided by the values of the resistances according to the switch key 210 operation signal of the four-pole earphone 20, which can be sent to the microphone plus port b (MIC+b). Then, the controller 100 can measure the current of the microphone bias port a (MIC_Bias a), and can measure the voltage of the microphone plus port b (MIC+b).

Thus, the controller 100 can measure the voltage of the microphone plus port b divided by the bias resistance value R1, the microphone impedance value Z1, and the switch resistance R2 value. For instance, while the switch key 210 is inputted, the controller 100 can measure the voltage of the microphone plus port b (MIC+b) according to the formula of dividing a parallel synthesis resistance value of the microphone impedance Z1 and the switch resistance R2 by the sum of the parallel synthesis resistance value of the microphone impedance Z1 and the switch resistance R2 and the bias resistance value R1 and multiplying it by the microphone bias reference voltage VDD. Moreover, the controller 100 can check the current value measured in the microphone bias port a (MIC_Bias a). Here, the controller 100 can sense that the current value of the microphone bias port a (MIC_Bias a) is changed according to the operation of the switch key 210 which is generated in the four-pole earphone 20. At this time, the current value of the microphone bias port a (MIC_Bias a) can be changed by the bias resistance value R1, the microphone impedance value Z1, and the switch resistance R2 value. Thereafter, the controller 100 determines whether the current of the measured microphone bias port a (MIC_Bias a) and the voltage of the microphone plus port b (MIC+b) are in the range of a preset specific range. At this time, the specific range is a range of the current of the microphone bias port and the voltage of the microphone plus port (MIC+b) which are generated when the switch key is inputted. This can be a range that is set by the microphone impedance, the switch resistance and the bias resistance. That is, the controller 100 can set the specific range according to the bias resistance value, the microphone impedance value, and the switch resistance value depending on the specific kind of earphone. Then, the controller 100 determines whether the current of the microphone bias port a (MIC_Bias a) and the voltage of the microphone plus port b (MIC+b) are simultaneously changed in case the current of the measured microphone bias port a (MIC_Bias a) and the voltage of the microphone plus port b (MIC+b) are in the range of a preset specific range. That is, in case the current of the microphone bias port a (MIC_Bias a) and the voltage of the microphone plus port b (MIC+b) are simultaneously changed, the controller 100 can determine this as a switch key operation signal caused by an input from the user. Hence, the controller 100 can prevent the malfunction caused by the contact between the earphone terminal and the interface unit 150 when attaching and detaching an earphone. That is, when the four-pole earphone 20 is connected through the interface unit 150, the controller 100 does not perform the function corresponding to the input of switch key 210 when the microphone terminal 3 is contacted to ground terminal GND of the interface unit 150. Moreover, when the four-pole earphone 20 is connected through the interface unit 150, the controller 100 does not perform the function corresponding to the input of switch key 210 when the ground terminal 4 is contacted with the microphone terminal of the interface unit 150. Moreover, when the three-pole earphone 20 is connected through the interface unit 150, the controller 100 does not perform the function corresponding to the input of switch key 210 when ground terminal is contacted with the microphone terminal of the interface unit 150.

Figure 4:
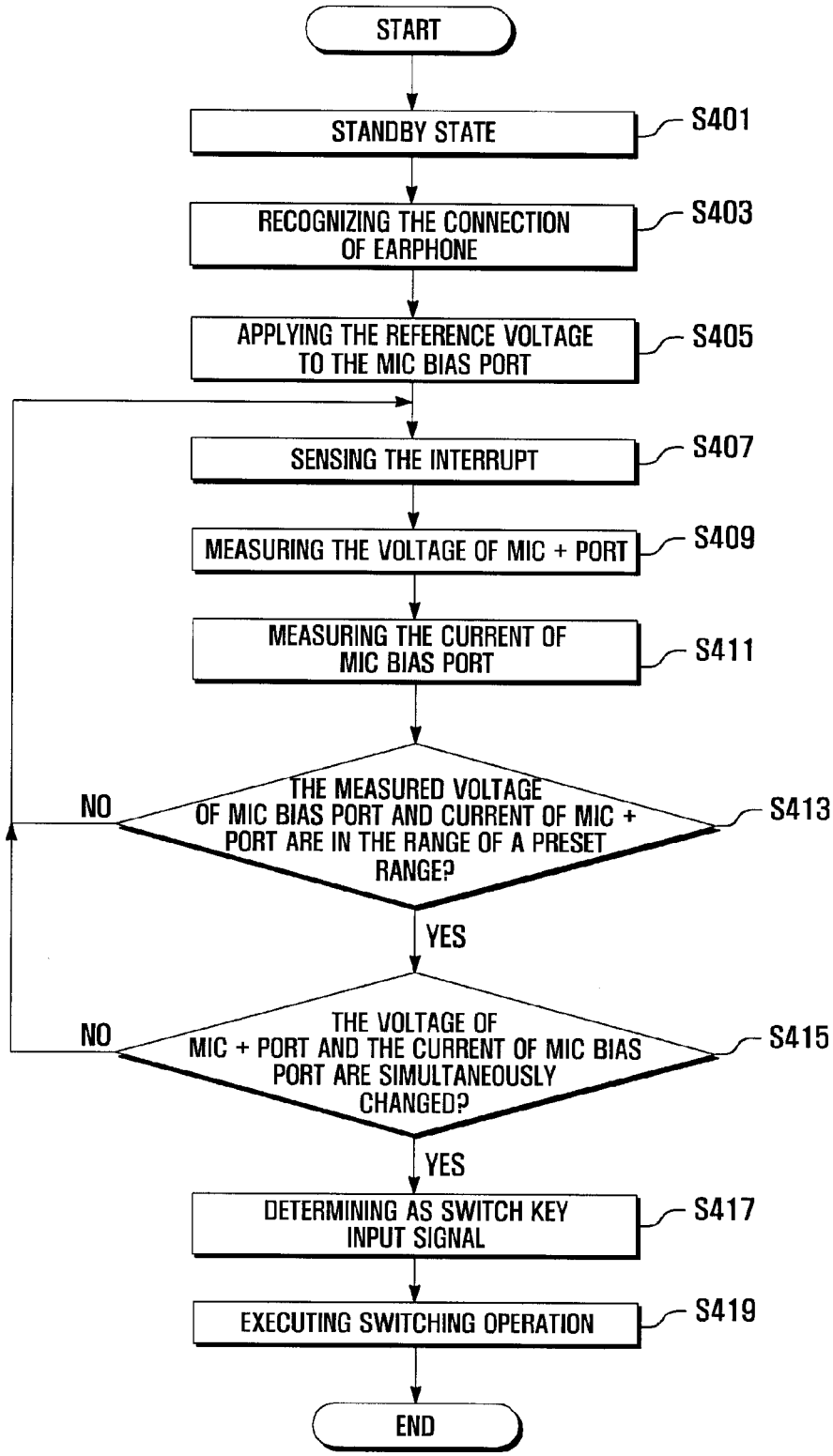
FIG. 4 is a flowchart for illustrating a switch operation of a portable terminal according to an exemplary embodiment of the present invention.

FIG. 4 is a flowchart for illustrating the switch operation of a portable terminal according to an exemplary embodiment of the present invention.

Hereinafter, the portable terminal using the four-pole earphone 20 is illustrated based on the voice communications of the portable terminal. However, the present invention is not limited to such function, but can be applied to various functions. Moreover, the four-pole earphone 20 is representatively illustrated as the specific earphone according to an exemplary embodiment of the present invention. That is, the embodiment of the present invention also can be applied to a three-pole earphone which can be connected through the interface unit 150 of the portable terminal.

Referring to FIG. 4, the controller 100 maintains a standby state (S401). The standby state can include a call standby state and a message reception standby state. Next, the controller 100 recognizes the connection of a four-pole earphone 20 (S403). Here, the controller 100 can check whether the connection of the four-pole earphone 20 is sensed in the interface unit 150. If the four-pole earphone 20 is connected to the interface unit 150, the controller 100 can apply a reference voltage VDD to the microphone bias port (MIC_Bias a) (S405). That is, the controller 100 controls a microphone bias power supply unit to apply the reference voltage VDD to the microphone bias port (MIC_Bias a). The controller 100 can sense the generation of interrupt after applying the reference voltage (S407). At this time, the interrupt can be generated by contact between the terminals in the process where a user connects the four-pole earphone 20 to the interface unit 150. For instance, the interrupt can be generated when the microphone terminal of the four-pole earphone is contacted with the ground terminal GND of the interface unit 150. Moreover, the interrupt can be generated when the ground terminal GND of the four-pole earphone is contacted with the microphone terminal of the interface unit 150. Moreover, the interrupt can be generated when the ground terminal GND of the three-pole earphone is contacted with the microphone terminal of the interface unit 150. If an interrupt is generated, the controller 100 can measure the voltage of the microphone plus port (MIC+b) (S409). At this time, before the switch key 210 is inputted, the controller 100 can measure the voltage which is divided according to the formula of dividing the microphone impedance value Z1 by the sum of the microphone impedance value Z1 and the bias resistance value R1 and multiplying it by the microphone bias reference voltage VDD. Alternatively, after the switch key 210 is inputted, the controller 100 can measure the voltage which is divided according to the formula of dividing a parallel synthesis resistance value of the switch resistance R2 and the microphone impedance Z1 by the sum of the parallel synthesis resistance value and the bias resistance value R1 and multiplying it by the microphone bias reference voltage VDD. Moreover, the controller 100 can measure the current of the microphone bias port (MIC_Bias a) (S411). At this time, before the switch key 210 is inputted, the controller 100 can measure the current value of the microphone bias port (MIC_Bias a) which is formed according to the bias resistance value R1 and the microphone impedance value Z1. Alternatively, after the switch key 210 is inputted, the controller 100 can measure the current value of the microphone bias port (MIC_Bias a) formed according to the bias resistance value R1 and the parallel synthesis resistance value of the mike impedance Z1 and the switch resistance R2. If the voltage of the microphone plus port (MIC+b) and the current of the microphone bias port (MIC_Bias a) are measured, the controller 100 determines whether the voltage of the microphone bias port (MIC_Bias a) and the current of the microphone plus port (MIC+b) are in the range of a preset range, i.e., in the range of the voltage of the microphone bias port (MIC_Bias a) and the current of the microphone plus port (MIC+b) in case of inputting the switch key 210 (S413). At this time, the controller 100 can pre-store the microphone impedance Z1 and switch resistance R2 value of the four-pole earphone 20. Hence, the controller 100 can analyze the generating interrupt and determine whether the voltage of the microphone bias port and the current of the microphone plus port are in the range of the preset range.

When the switch key 210 is inputted, the controller 100 stores the range of the voltage of the microphone plus port (MIC_Bias a) which is formed by the formula of dividing a parallel synthesis resistance value of the microphone impedance Z1 and the switch resistance R2 by the sum of the parallel synthesis resistance value of the microphone impedance Z1 and the switch resistance R2 and the bias resistance value R1 and multiplying it by the microphone bias reference voltage VDD. Moreover, when the switch key 210 is inputted, the controller 100 can store the range of the current of the microphone bias port which is changed according to the bias resistance value R1, the microphone impedance value Z1, and the switch resistance R2 value. As a result, in case the voltage of the microphone plus port (MIC+b) and the current of the microphone bias port (MIC_Bias a) are in within the preset range, the controller 100 determines whether the voltage of the microphone plus port (MIC+b) and the current of the microphone bias port (MIC_Bias a) are simultaneously changed (S415). At this time, if it is sensed that the voltage of the microphone plus port (MIC+b) and the current of the microphone bias port (MIC_Bias a) are simultaneously changed, the controller 100 can determine that the interrupt generated was caused by the input of switch key 210 of user (S417). In the meantime, in case the change of the voltage of the microphone plus port (MIC+b) and the current of the microphone bias port (MIC_Bias a) for the interrupt does not satisfy a preset range at step 413 or in case it is determined that the voltage of the microphone plus port (MIC+b) and the current of the microphone bias port (MIC+b) are not simultaneously changed, the controller 100 determines the interrupt is not caused by the input of switch key 210 of user at step 417, and, returns to step 407.

If it is determined that the interrupt caused by the input of switch key 210 of user at step 417, the controller 100 can execute the function corresponding to the input of switch key 210 (S419). At this time, the controller 100 can perform the switch key 210 function such as dialing, hang up, and call receiving.

Figure 5:
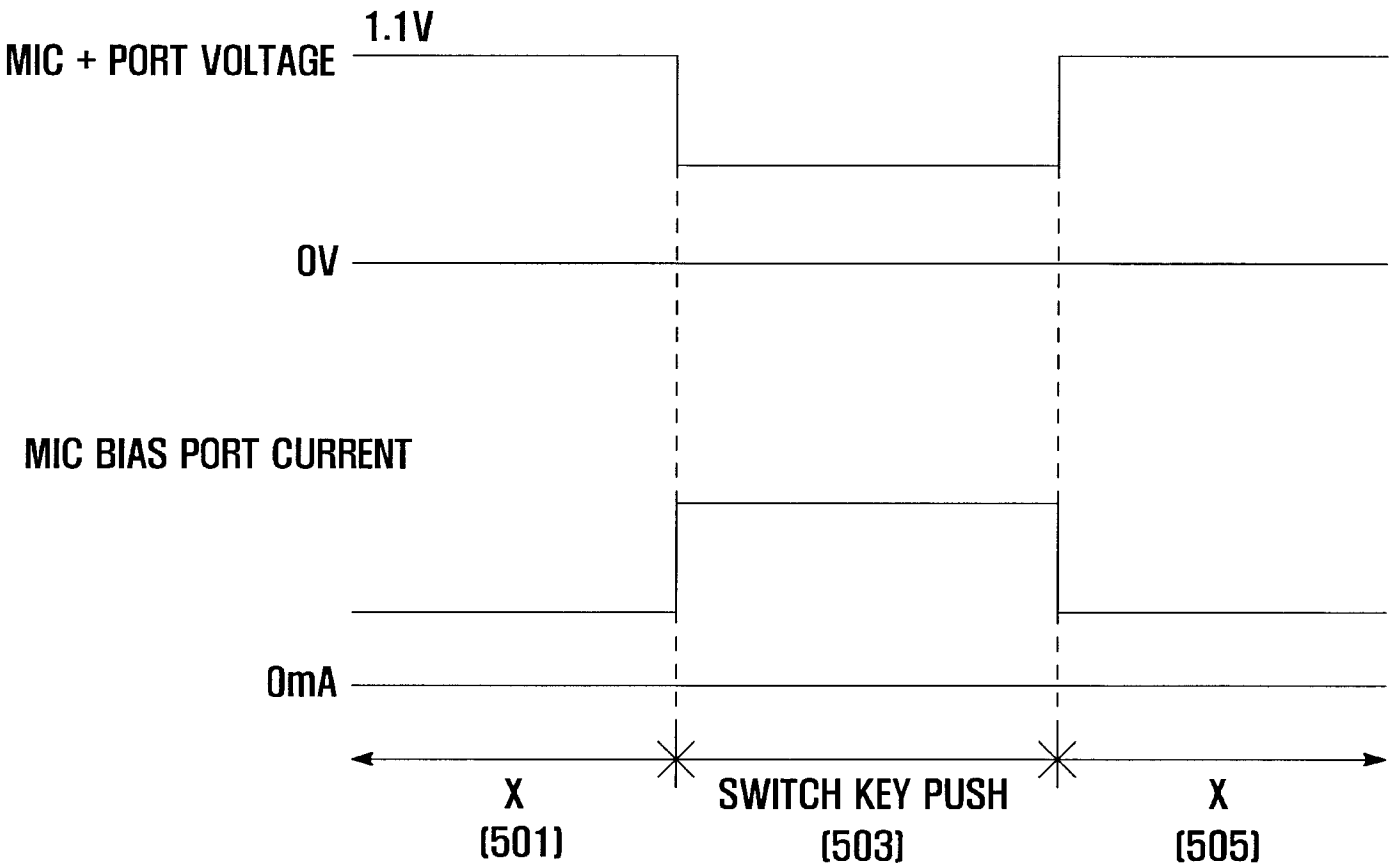
FIG. 5 is a drawing illustrating a process of determining switch operation according to voltage of mike plus port and current of mike bias port of a portable terminal according to an exemplary embodiment of the present invention.

FIG. 5 is a drawing illustrating a process of determining switch operation according to the voltage of microphone plus port (MIC+b) and the current of microphone bias port (MIC_Bias a) of a portable terminal according to an exemplary embodiment of the present invention.

Referring to FIG. 5, if the four-pole earphone 20 is connected through the interface unit 150, the portable terminal controls the microphone bias power supply unit to supply the reference voltage VDD to the microphone bias port a (MIC_Bias a). For instance, the portable terminal can control the microphone bias power supply unit to supply the reference voltage VDD of 2.2V to the microphone bias port a (MIC_Bias a). If the reference voltage VDD is applied to the microphone bias port a (MIC_Bias a), until the switch key 210 of the four-pole earphone 20 is inputted, a voltage, which is formed by the formula of dividing the microphone impedance value Z1 by the sum of the microphone impedance value Z1 and the bias resistance value R1 and multiplying it by the microphone bias reference voltage VDD, can be applied to the microphone plus port b (MIC+b). At this time, the controller 100 continuously maintains the voltage applied to the microphone plus port b (MIC+b). Moreover, until the switch key 210 of the four-pole earphone 20 is inputted, the current of the microphone bias port a (MIC_Bias a) can be changed by microphone impedance value Z1 and the bias resistance value R1 and can be measured. For instance, if the microphone impedance value Z1 is 2.2KΩ and the bias resistance value R1 is 2.2KΩ, the voltage divided by the microphone plus port b (MIC+b) through voltage dividing can be 1.1V, and the current of the microphone bias port a (MIC_Bias a) when an input signal of the switch key 210 is not generated can flow by the impedance Z1 value and the bias resistance value R1 (501). Then, the portable terminal can measure whether the current of the microphone bias port a (MIC_Bias a) and the voltage of microphone plus port b (MIC+b) are changed. At this time, if input signal of the switch key 210 is generated, the portable terminal can measure the change of the current of the microphone bias port a (MIC_Bias a) and the voltage of microphone plus port b (MIC+b). That is, the portable terminal can sense that the current of the microphone bias port a (MIC_Bias a) and the voltage of microphone plus port b (MIC+b) are changed by the bias resistance value R1, the microphone impedance value Z1, and the switch resistance R2 value. Here, the portable terminal can determine whether the measured current of the microphone bias port a (MIC_Bias a) and voltage of microphone plus port b (MIC+b) are in of the preset range and can determine whether the switch key 210 is practically inputted. Moreover, the portable terminal can determine whether the current of the microphone bias port a (MIC_Bias a) and the voltage of microphone plus port b (MIC+b) are simultaneously changed. For instance, if the switch key 210 is inputted, the portable terminal can sense that the voltage value of the microphone plus port b (MIC+b) is reduced according to the formula of dividing the parallel synthesis resistance value of the microphone impedance Z1 and the switch resistance R2 by the sum of the parallel synthesis resistance value and the bias resistance value R1 and multiplying it by the microphone bias reference voltage VDD, whereas the current value of the microphone bias port (MIC_Bias a) is changed and increased by the bias resistance value R1, the microphone impedance value Z1, and the switch resistance R2 value (503).

Moreover, if the input of the switch key 210 is canceled, the portable terminal can sense that the current of the microphone bias port a (MIC_Bias a) and the voltage of microphone plus port b (MIC+b) are changed into the state prior to the input of the switch key 210. For instance, if the input of the switch key 210 of the four-pole earphone 20 is canceled, the portable terminal can measure the voltage which is formed by the formula of dividing the microphone impedance value Z1 by the sum of the microphone impedance value Z1 and the bias resistance value R1 and multiplying it by the microphone bias reference voltage VDD. Moreover, if the input of the switch key 210 is canceled, the controller 100 can sense that the current of the microphone bias port a (MIC_Bias a) is changed by the microphone impedance value Z1 and the bias resistance value R1 (505). According to the present invention, the mis-identification or mis-operation of the switch operation, which is generated when a three-pole earphone is inserted into the four-pole ear-jack or the four-pole earphone is inserted or removed, can be prevented. Moreover, the portable terminal can restrict the performance of the switch operation in a specific earphone according to the microphone impedance of earphone. Moreover, the portable terminal can restrict the performance of the switch operation in a specific earphone according to the switch resistance value of the earphone. Moreover, the portable terminal measures the current of the microphone bias port (MIC_Bias a) and measures the voltage of the microphone plus port (MIC+b) to recognize the operation of the switch key, so that it can use various earphones through a single circuit having universality.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

What is claimed is:

1. An apparatus for recognizing an earphone of a portable terminal, comprising:

an interface unit which is connected to the earphone;

a controller which performs a switch operation by storing a value range of a first port and a second port and determining whether a switch key of the earphone is inputted, according to a change of a current of a first port and a voltage of a second port, when the connection of earphone is sensed by comparing the value range to the change of the current of the first port and the voltage of the second port; and an audio processing unit which outputs an audio signal to the earphone under the control of the controller.

2. The apparatus of claim 1, wherein, in case the earphone is a three-pole earphone, the interface unit senses a contact of a left side ear speaker terminal, a right side ear speaker terminal, and a ground terminal.

3. The apparatus of claim 1, wherein, in case the earphone is a four-pole earphone, the interface unit senses a contact of a left side ear speaker terminal, a right side ear speaker terminal, a microphone terminal and a ground terminal.

4. The apparatus of claim 1, wherein, in case the earphone is connected, the controller applies a reference voltage to the first port.

5. The apparatus of claim 1, wherein the controller determines whether a current of the first port and a voltage of the second port satisfy a range that is set by a microphone impedance, a switch resistance and a bias resistance of the earphone.

6. The apparatus of claim 5, wherein the set range is one of: a current range of the first port and a voltage range of the second specific port, in case a reference voltage is divided by the microphone impedance, the switch resistance and the bias resistance of the earphone.

7. The apparatus of claim 5, wherein the controller determines whether the change of the current of the first port and the voltage of the second port occurred simultaneously.

8. A method of recognizing an earphone of a portable terminal, the method comprising:

sensing whether an earphone is connected to an interface unit;

storing in a controller a value range of a first port and a second port and applying a reference voltage to a first port, and measuring a change of a current of the first port and a voltage of a second port, when the connection of earphone is sensed in the interface unit;

determining whether a switch key of the earphone is inputted, according to a result of the measurement by comparing the value range to the change of the current of the first port and the voltage of the second port; and executing a switch operation after determining a switch key is inputted.

9. The method of claim 8, wherein sensing whether an earphone is connected to an interface unit comprises, in case the earphone is a three-pole earphone, sensing a contact of a left side ear speaker terminal, a right side ear speaker terminal, and a ground terminal.

10. The method of claim 8, wherein sensing whether an earphone is connected to an interface unit comprises, in case the earphone is a four-pole earphone, sensing a contact of a left side ear speaker terminal, a right side ear speaker terminal, a microphone terminal and a ground terminal.

11. The method of claim 8, wherein measuring a change of a current of the first port and a voltage of the second port further comprises determining whether a current of the first port and a voltage of the second port satisfy a range that is set by a microphone impedance, a switch resistance and a bias resistance of the earphone.

12. The method of claim 11, wherein the set range is a current range of the first port or a voltage range of the second port, in case a reference voltage is divided by the microphone impedance, the switch resistance and the bias resistance of the earphone.

13. The method of claim 11, further comprising determining whether the change of the current of the first port and the voltage of the second port occurred simultaneously, in case the range is satisfied as a result of the determination.

14. The method of claim 8, wherein executing a switch operation comprises controlling an audio signal output to the earphone.

15. A method operable in a portable device for determining an earphone connection, the method comprising:

detecting the presence of the earphone connection;

storing in a controller a value range of a first port and a second port and measuring an electrical current at a first port and an electrical voltage at a second port;

determining whether each of the measured electrical current and the electrical voltage are within corresponding value ranges; and validating an input as being appropriate when the current and the voltage change simultaneously.

16. The method of claim 15, wherein the input is associated with a switch key.

17. The method of claim 15, further comprising:

performing a function corresponding to the input.

18. The method of claim 17, wherein the function is selected as one of: a hang-up, a dialing and a call receiving.

* * * * *